US010520181B1

(12) United States Patent
Chen

(10) Patent No.: US 10,520,181 B1
(45) Date of Patent: Dec. 31, 2019

(54) DIRECT CONNECTOR FOR LAMP BASE AND LIGHT SOURCE DRIVER BOARD AND LED BULB LAMP USING DIRECT CONNECTOR

(71) Applicant: DONGGUAN GHGM PRECISE TECHNOLOGY CO., LTD, Dongguan (CN)

(72) Inventor: Bingshui Chen, Dongguan (CN)

(73) Assignee: DONGGUAN GHGM PRECISE TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 16/107,477

(22) Filed: Aug. 21, 2018

(30) Foreign Application Priority Data

Jul. 13, 2018 (CN) ..... 2018 1 0771603

(51) Int. Cl.

| | |
|---|---|
| ***F21V 23/06*** | (2006.01) |
| ***F21K 9/238*** | (2016.01) |
| ***F21V 23/00*** | (2015.01) |
| ***F21V 19/00*** | (2006.01) |

(52) U.S. Cl.
CPC ..... *F21V 23/06* (2013.01); *F21K 9/238* (2016.08); *F21V 19/0045* (2013.01); *F21V 23/006* (2013.01)

(58) Field of Classification Search
None
See application file for complete search history.

(56) References Cited

U.S. PATENT DOCUMENTS

| | | | | |
|---|---|---|---|---|
| 7,575,362 | B1 * | 8/2009 | Hsu | H01R 33/09 362/647 |
| 9,863,622 | B1 * | 1/2018 | Armer | F21V 23/0414 |
| 9,897,264 | B1 * | 2/2018 | Chen | F21K 9/235 |
| 2018/0216788 | A1 * | 8/2018 | Bugenske | F21V 19/02 |

* cited by examiner

*Primary Examiner* — Ashok Patel
(74) *Attorney, Agent, or Firm* — Muncy, Geissler, Olds & Lowe, P.C.

(57) ABSTRACT

Direct connector for a lamp base and a light source driver board, mounted at the joint of the lamp base and a lamp cup. Its insulating base has a positive metal contact pin and a negative metal contact pin towards the lamp cup, which are electrically connected to the light source driver board. The insulating base has an insertion groove towards the lamp base, and a rivet of the lamp base is inserted. A positive conductor to be electrically connected to the rivet is disposed in the insertion groove and is in electrical conduction with the positive metal contact pin. A negative conductor to tightly press against a side wall of the lamp base for electrical connection is disposed on the side face of the insulating base and is in electrical conduction with the negative metal contact pin. An LED bulb lamp using the direct connector is further disclosed.

10 Claims, 10 Drawing Sheets

DIRECT CONNECTOR FOR LAMP BASE AND LIGHT SOURCE DRIVER BOARD AND LED BULB LAMP USING DIRECT CONNECTOR

BACKGROUND OF THE INVENTION

Technical Field

The invention relates to LED bulbs, in particular to a direct connector structure for a lamp base and a light source driver board in an LED bulb, and an LED bulb lamp using the direct connector.

Description of Related Art

Generally, the lamp base and the light source driver board of an LED bulb are electrically connected through a wire having two ends respectively welded to the lamp base and the light source driver board. However, this connection method is not suitable for automatic production due to complex assembly operation, unreliable connection and high costs.

Although certain electrical connection structures have been developed nowadays by manufacturers to facilitate assembly and connection between the lamp base and the light source driver board, these existing electrical connection structures are typically complex, have too many connection components and are inconvenient to assemble and high in cost, thereby having yet to be improved.

BRIEF SUMMARY OF THE INVENTION

One objective of the invention is to provide a direct connector for a lamp base and a light source driver board, which has a simple structure and few components and is convenient to assemble and low in cost.

Another objective of the invention is to provide an LED bulb lamp using the direct connector.

To fulfill the above objectives, the following solution is adopted by the invention:

A direct connector for a lamp base and a light source driver board is mounted at the joint of a lamp base and a lamp cup and provided with an insulating base. The insulating base is provided with a positive metal contact pin and a negative metal contact pin towards the lamp cup. The positive metal contact pin and the negative metal contact pin are electrically connected to a light source driver board. The insulating base is provided with an insertion groove towards the lamp base, and a rivet of the lamp base is inserted into the insertion groove. A positive contactor to be electrically connected to the rivet of the lamp base is disposed in the insertion groove and is in electrical conduction with the positive metal contact pin. A negative conductor is disposed on the side face of the insulating base to tightly press against a side wall of the lamp base to achieve electrical connection and is in electrical conduction with the negative metal contact pin.

The insulating base is made from plastic materials.

The insulating base is integrally provided with an insertion pillar towards the lamp cup, and the positive metal contact pin and the negative metal contact pin are inserted into the insertion pillar.

The positive metal contact pin and the positive conductor are integrated. The positive conductor is bent to be in an n shape and erected on a side, towards the lamp base, of the insulating base and has an end connected to the positive metal contact pin and an end inserted into the insertion groove to be electrically connected to the rivet of the lamp base.

The negative metal contact pin and the negative conductor are integrated. The negative conductor is a linear conductor, is bent to be in an n shape and erected on the side, towards the lamp base, of the insulating base and has an end connected to the negative metal contact pin and an end located on the side face of the insulating base to tightly press against a side wall of the lamp base to achieve electrical connection.

An end, towards the lamp base, of the negative metal contact pin is bent to be in an n shape, erected on the side, towards the lamp base, of the insulating base and then inserted into a clamping groove formed in the insulating base towards the lamp base. The negative conductor is an elastic piece-type conductor. The root portion of the negative conductor is inserted into the clamping groove to be electrically connected to the negative metal contact pin. An elastic piece of the negative conductor is located on the side face of the insulating base and tightly presses against and makes contact with the side wall of the lamp base to achieve electrical connection by means of the elasticity of the elastic piece.

The insulating base is provided with a plug towards the lamp cup and provided with a positive socket and a negative socket towards the lamp base, and the positive socket and the negative socket are communicated with the plug. The positive metal contact pin and the negative metal contact pin are integrated in a circuit board and stretch out of two ends of the circuit board. The circuit board is inserted into the plug. The positive metal contact pin has an end stretching into the positive socket to be in electrical conduction with the positive conductor and an end electrically connected to the light source driver board. The negative metal contact pin has an end stretching into the negative socket to be in electrical conduction with the negative conductor and an end electrically connected to the light source driver board. The positive conductor is bent to be in an n shape and erected on a side, towards the lamp base, of the insulating base and has an end inserted into the positive socket to be electrically connected to the positive metal contact pin and an end inserted into the insertion groove to be electrically connected to the rivet of the lamp base. The negative conductor is an elastic piece-type conductor. The root portion of the negative conductor is inserted into the negative socket to be electrically connected to the negative metal contact pin. An elastic piece of the negative conductor is located on the side face of the insulating base and tightly presses against and makes contact with the side wall of the lamp base to achieve electrical connection by means of the elasticity of the elastic piece.

The insulating base is provided with a plug towards the lamp cup and provided with a positive socket and a negative socket towards the lamp base, and the positive socket and the negative socket are communicated with the plug. The positive metal contact pin and the negative metal contact pin are integrated in a PCB and stretch out of two ends of the PCB. The PCB is inserted into the plug. The positive metal contact pin has an end stretching into the positive socket to be in electrical conduction with the positive conductor and an end electrically connected to the light source driver board. The negative metal contact pin has an end stretching into the negative socket to be in electrical conduction with the negative conductor and an end electrically connected to the light source driver board. The positive conductor is bent to be in an n shape and erected on a side, towards the lamp base, of the insulating base and has an end inserted into the positive socket to be electrically connected to the positive metal contact pin and an end inserted into the insertion groove to be electrically connected to the rivet of the lamp base. The negative conductor is an elastic piece-type conductor. The root portion of the negative conductor is inserted into the negative socket to be electrically connected to the negative metal contact pin. An elastic piece of the negative conductor is located on the side face of the insulating base and tightly presses against and makes contact with the side wall of the lamp base to achieve electrical connection by means of the elasticity of the elastic piece.

The insulating base is provided with a plug towards the lamp cup and provided with a positive socket and a negative socket towards the lamp base, and the positive socket and the negative socket are communicated with the plug. The positive metal contact pin and the negative metal contact pin are wires and are inserted into the plug. The positive metal contact pin has an end stretching into the positive socket to be in electrical conduction with the positive conductor and an end electrically connected to the light source driver board. The negative metal contact pin has an end stretching into the negative socket to be in electrical conduction with the negative conductor and an end electrically connected to the light source driver board. The positive conductor is bent to be in an n shape and erected on a side, towards the lamp base, of the insulating base and has an end inserted into the positive socket to be electrically connected to the positive metal contact pin and an end inserted into the insertion groove to be electrically connected to the rivet of the lamp base. The negative conductor is an elastic piece-type conductor. The root portion of the negative conductor is inserted into the negative socket to be electrically connected with the negative metal contact pin. An elastic piece of the negative conductor is located on the side face of the insulating base and tightly presses against and makes contact with the side wall of the lamp base to achieve electrical connection by means of the elasticity of the elastic piece.

The insulating base is round and is provided with a reinforcing rib, or is cuboid.

An LED bulb lamp comprises a lamp base, a lamp cup, a light source driver board and a bulb-shaped lampshade. The lampshade and the lamp base are respectively disposed at two ends of the lamp cup. The light source driver board is disposed in the lamp cup and electrically connected to the lamp base through the direct connector.

By adoption of the above structure, the invention has a simple structure and few components. In the assembling process, the direct connector is mounted at the joint of the lamp base and the lamp cup, electrical connection to the light source driver board is achieved through the positive metal contact pin and the negative metal contact pin, the rivet of the lamp base and the side wall of the lamp base are electrically connected through the positive contactor and the negative conductor, and thus, the lamp base and the light source driver board are rapidly and electrically connected; and assembly operation is convenient, and both the production cost and the assembly cost of products are lower.

Figure 1:
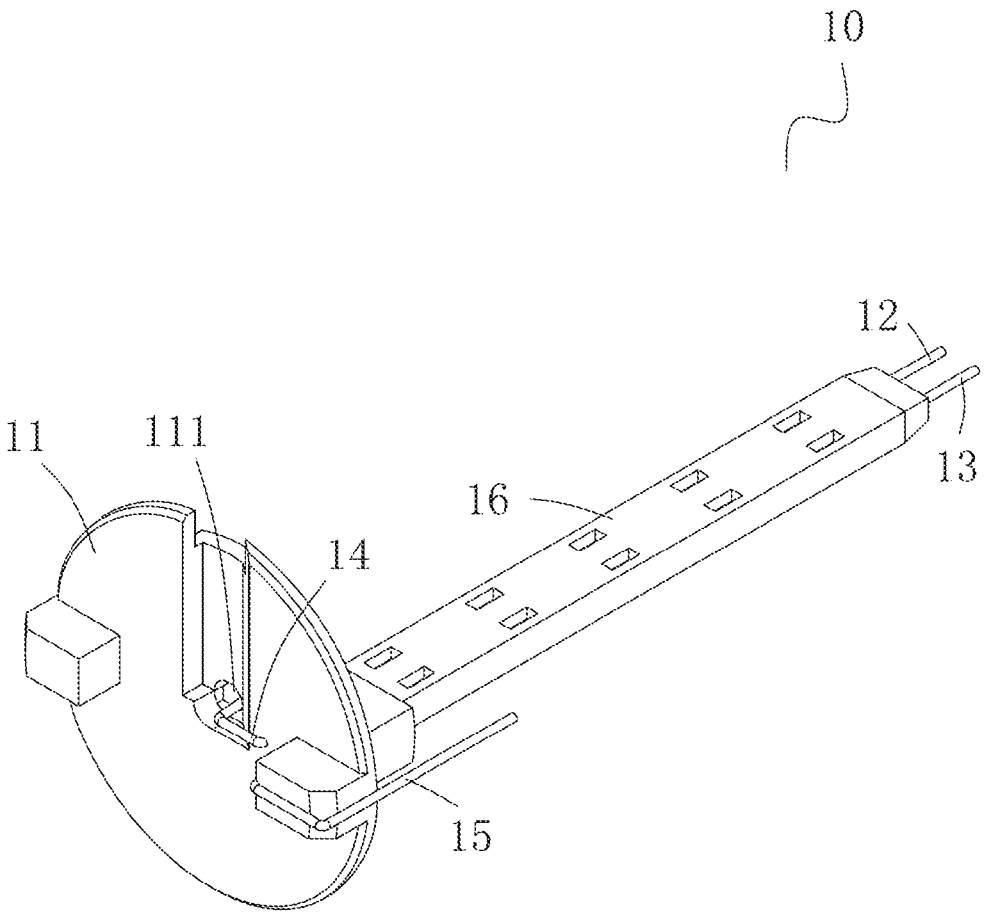
FIG. 1 is a structural view of a direct electrical connector in the first embodiment of the invention.

REFERENCE SIGNS direct connector 10, insulating base 11, insulating sleeve 100, reinforcing rib 110, insertion groove 111, clamping groove 112; positive metal contact pin 12, negative metal contact pin 13, positive conductor 14, negative conductor 15, insertion pillar 16, plug 17, positive socket 181, negative socket 182, PCB 19; lamp base 20, rivet 21, side wall 22; lamp cup 30; light source driver board 40, terminal 41.

DETAILED DESCRIPTION OF THE INVENTION

Figure 2:
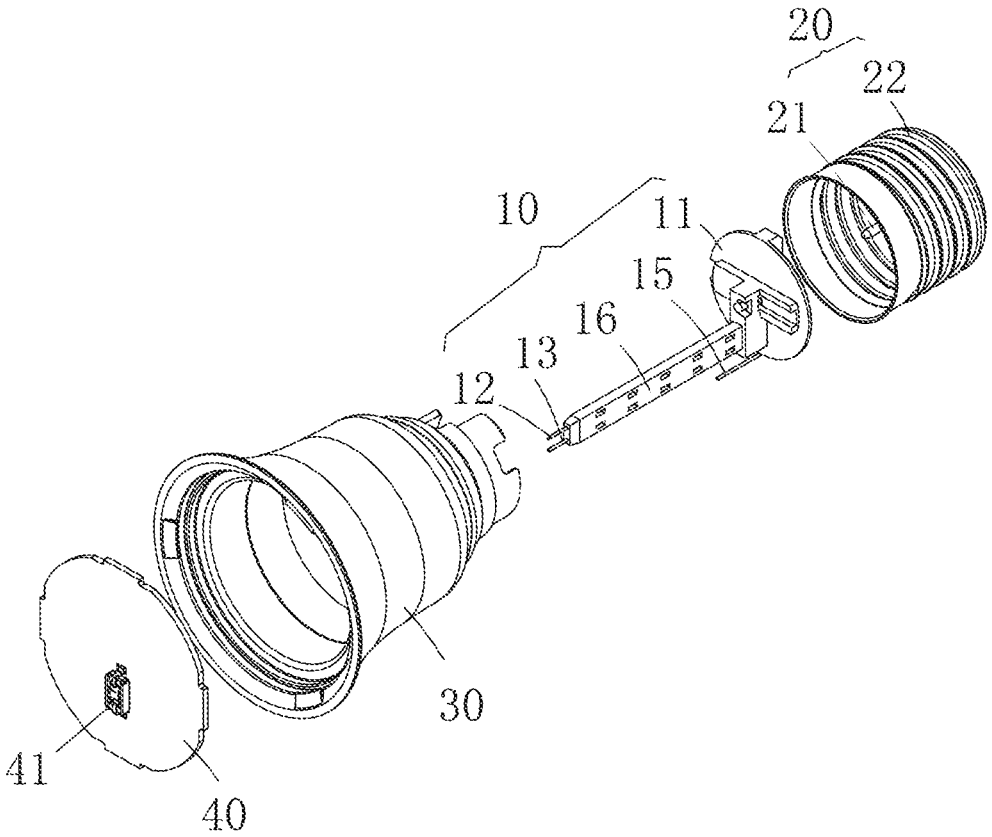
FIG. 2 is a disassembled perspective view of an LED bulb lamp using the structure in FIG. 1.
Figure 3:
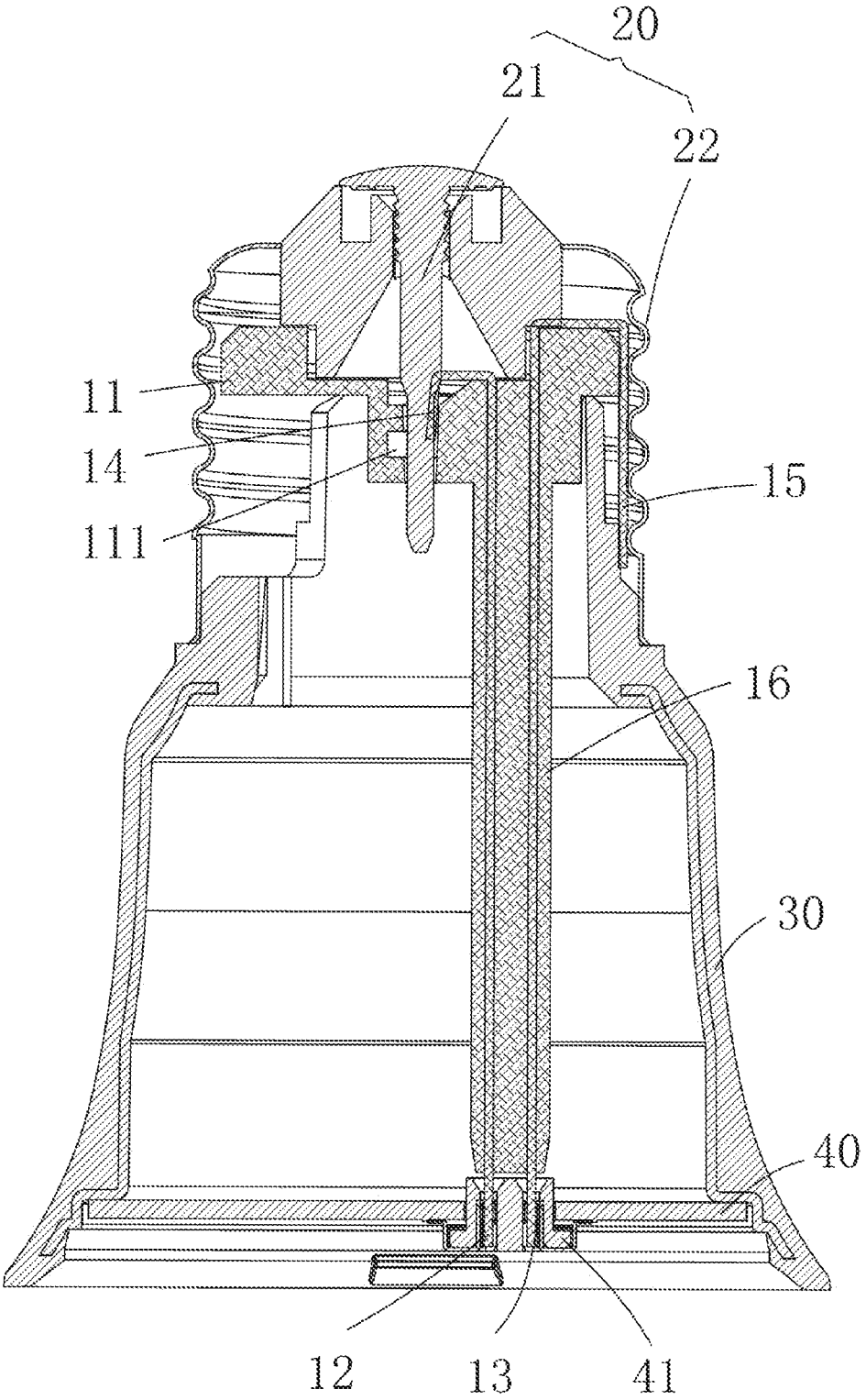
FIG. 3 is a sectional view of the structure in FIG. 2.
Figure 4:
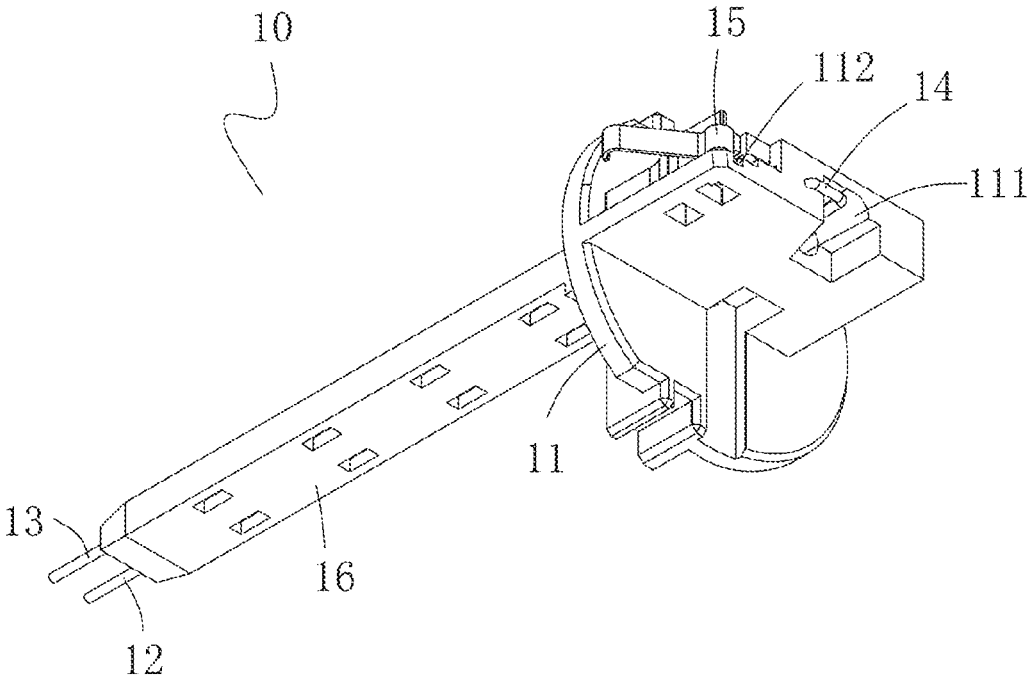
FIG. 4 is a structural view of a direct electrical connector in the second embodiment of the invention.
Figure 5:
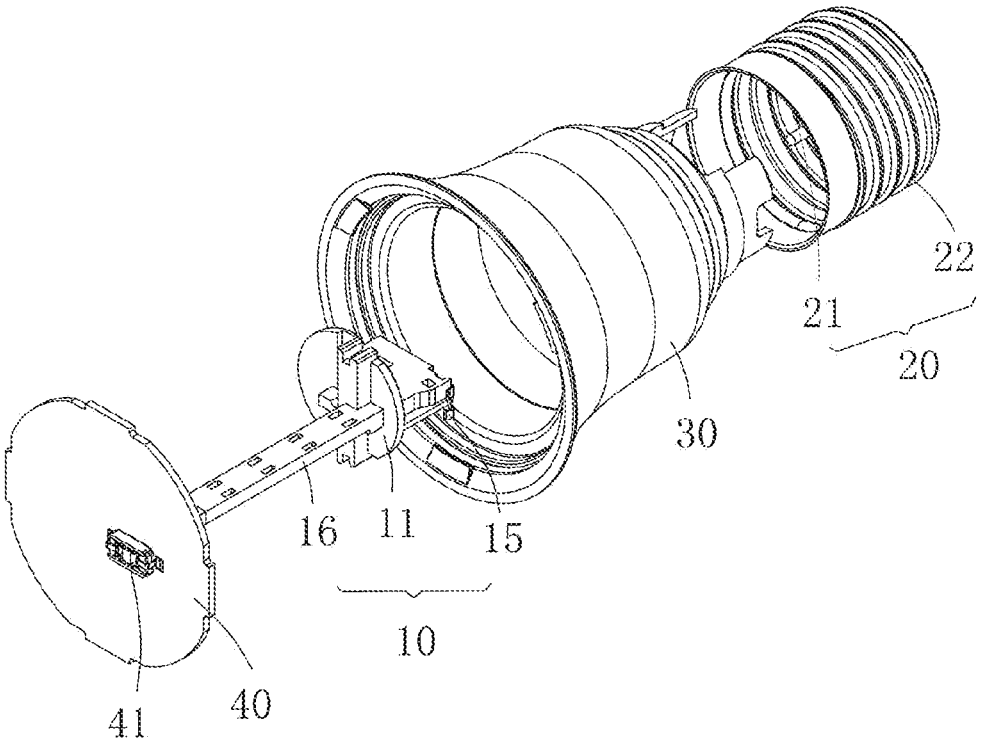
FIG. 5 is a disassembled perspective view of an LED bulb lamp using the structure in FIG. 4.
Figure 6:
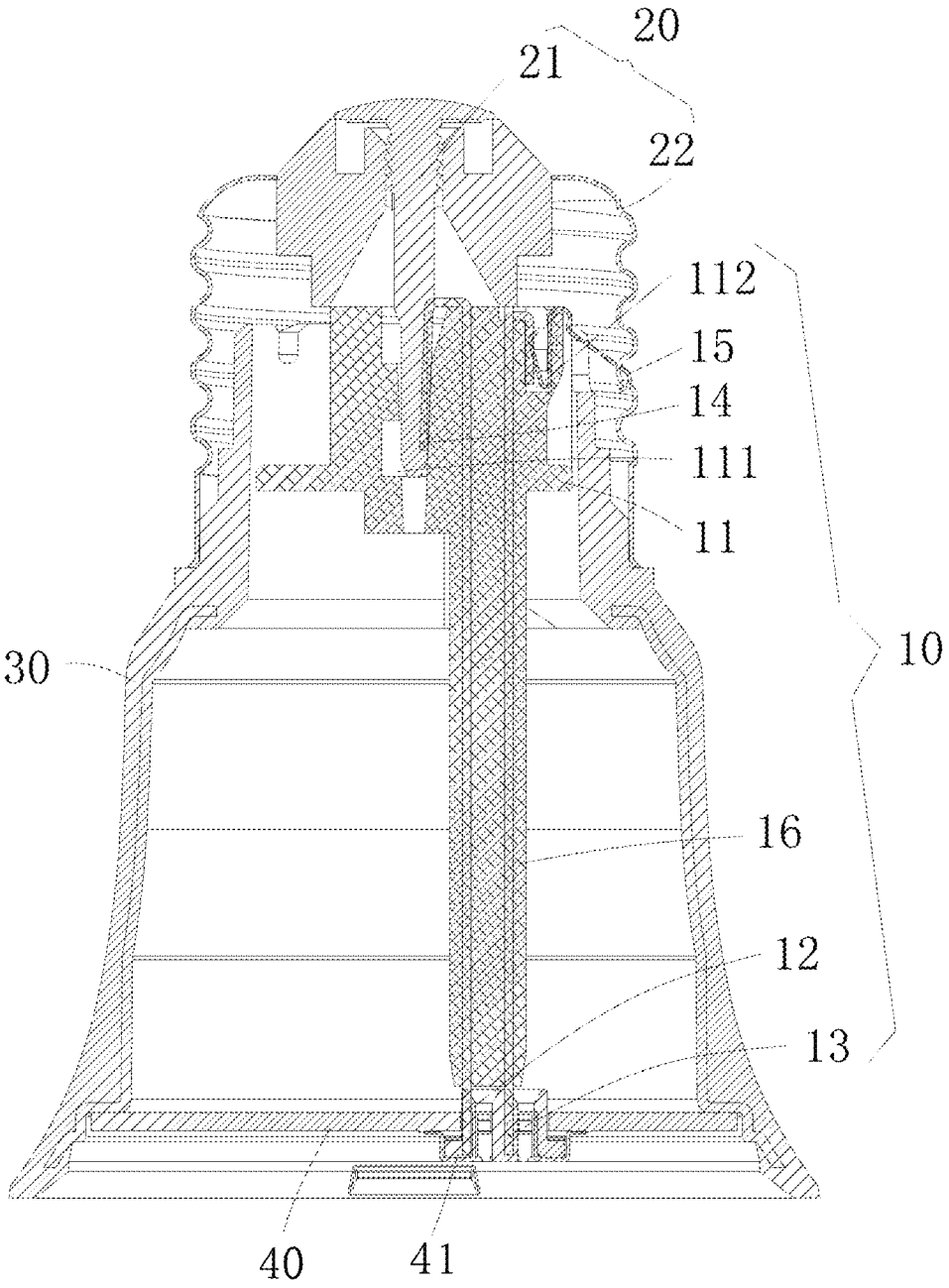
FIG. 6 is a sectional view of the structure in FIG. 5.
Figure 7:
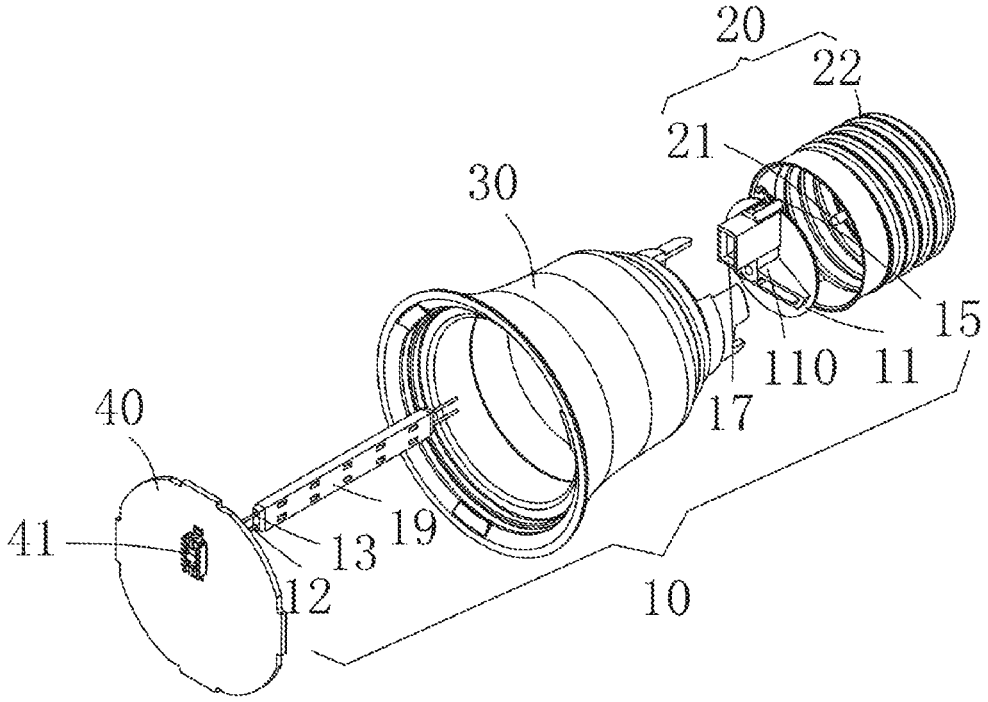
FIG. 7 is a disassembled perspective view of an LED bulb lamp using a direct electrical connector in the third embodiment of the invention.
Figure 8:
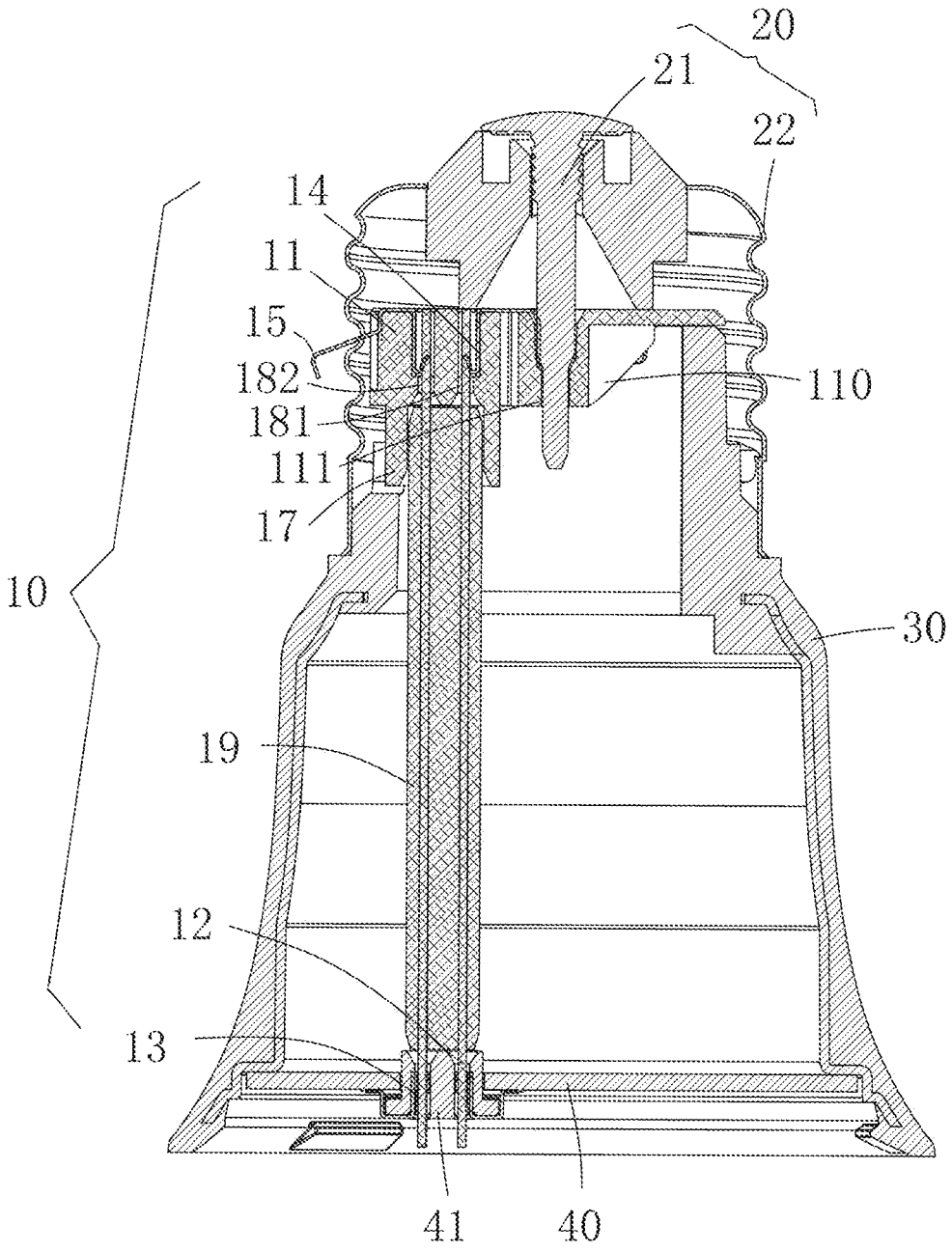
FIG. 8 is a sectional view of the structure in FIG. 7.
Figure 9:
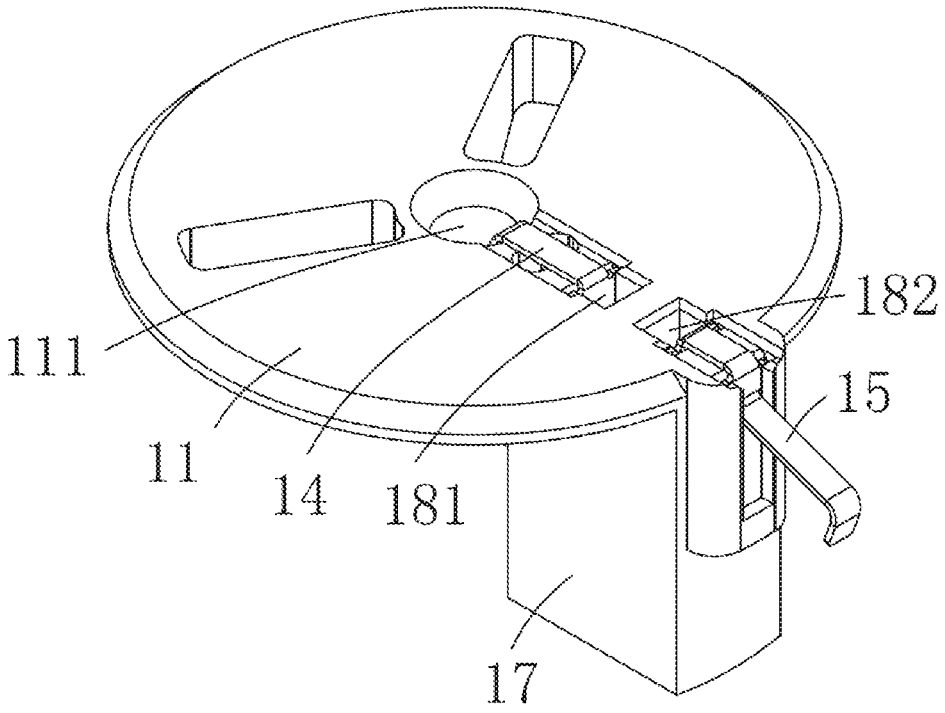
FIG. 9 is a structural view of an insulating base in the third embodiment.
Figure 10:
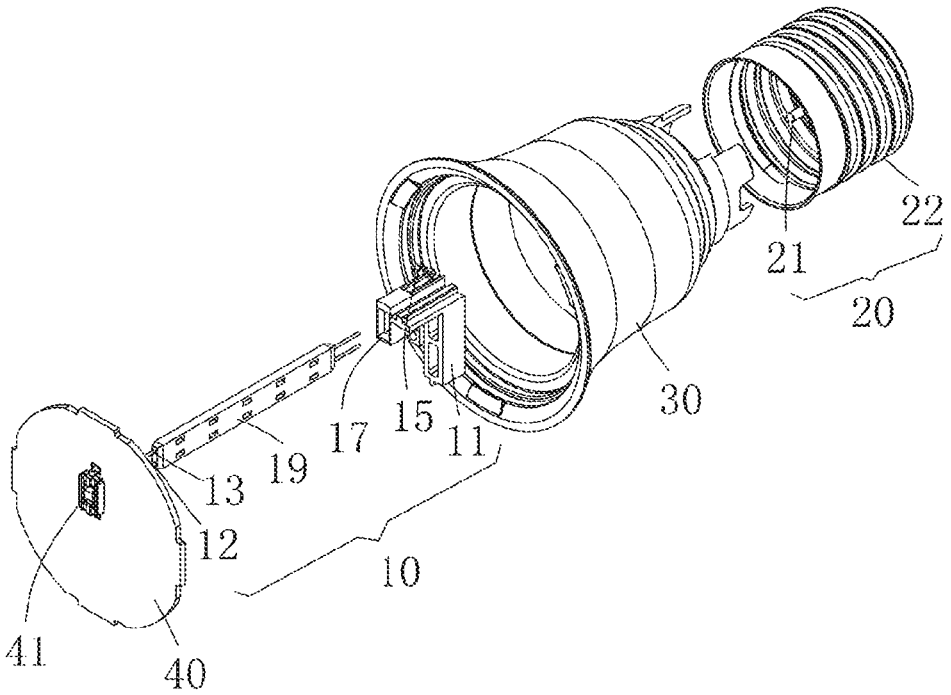
FIG. 10 is a disassembled perspective view of an LED bulb lamp using a direct electrical connector in the fourth embodiment of the invention.
Figure 11:
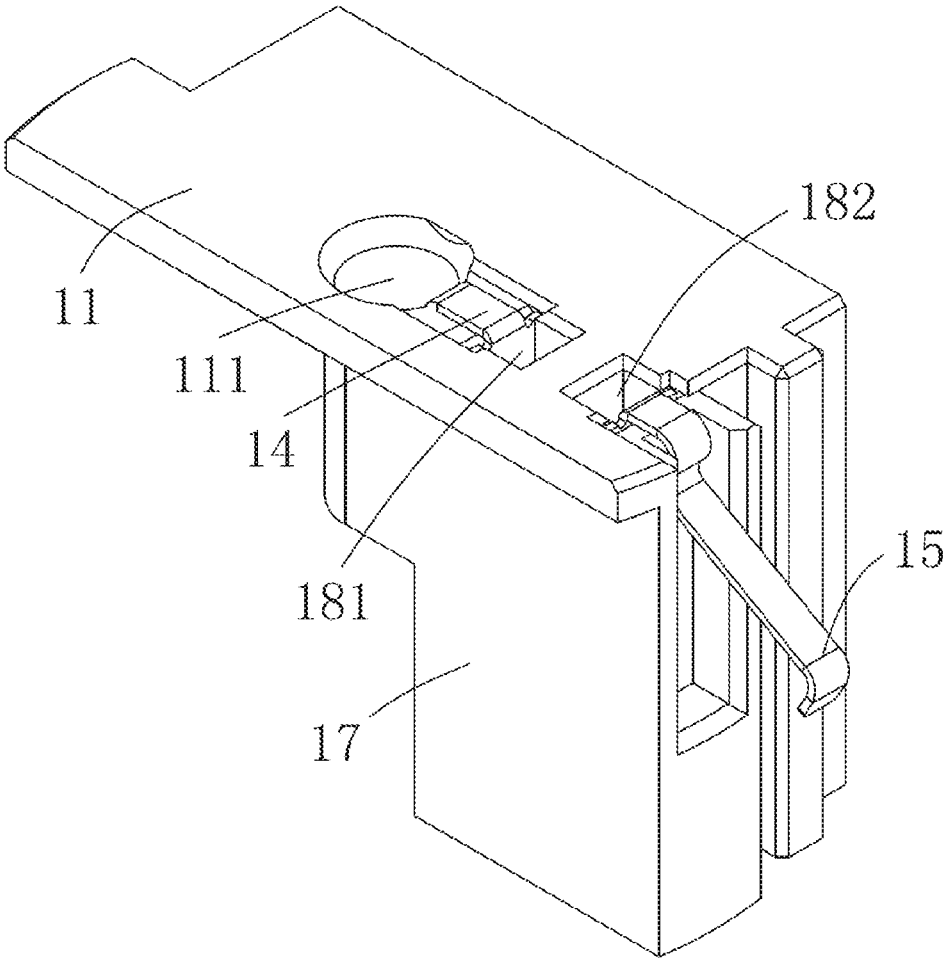
FIG. 11 is a structural view of an insulating base in the fourth embodiment.
Figure 12:
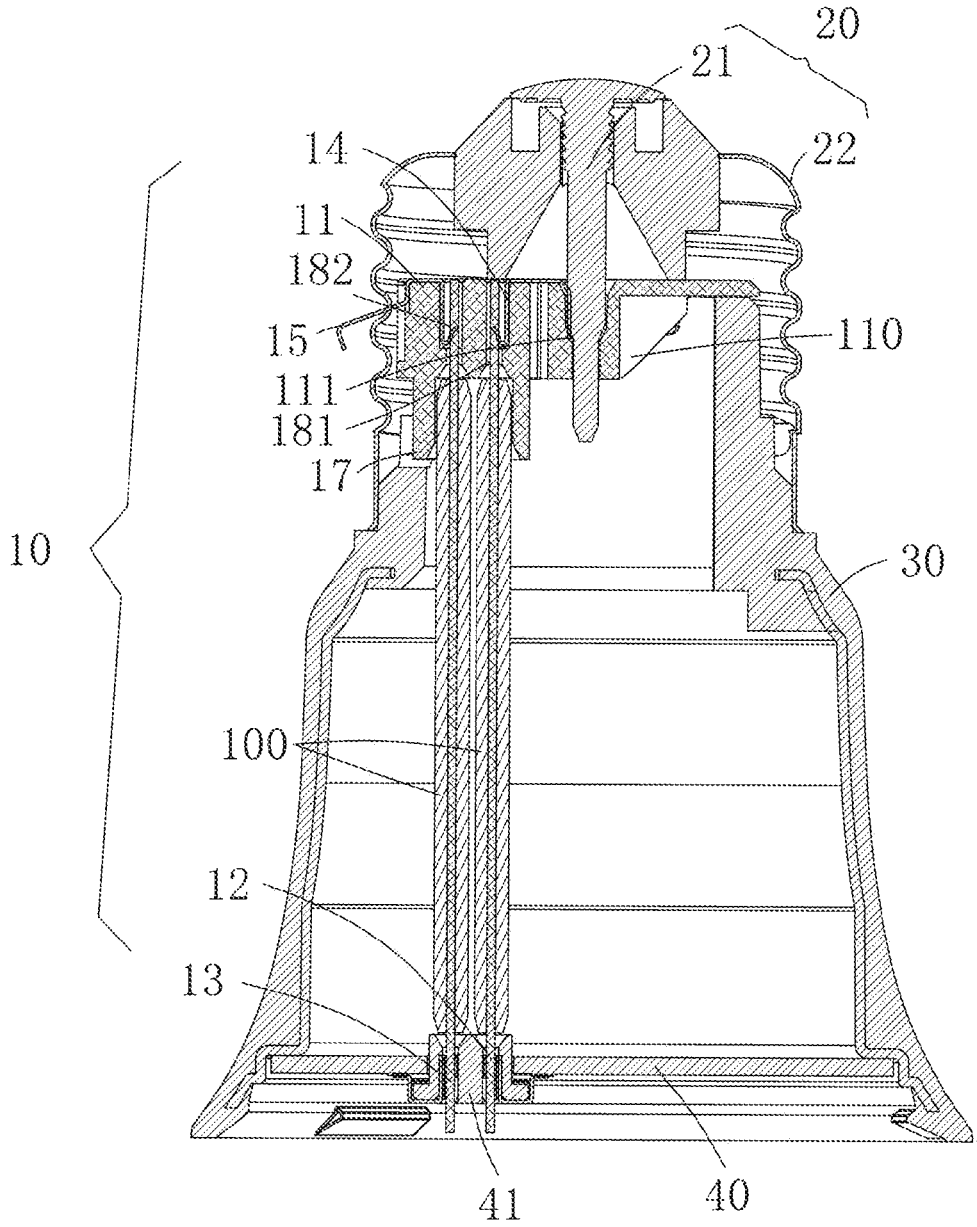
FIG. 12 is a sectional view of an LED bulb lamp using a direct electrical connector in the fifth embodiment of the invention.

As shown in FIGS. 1-12, the invention discloses a direct connector 10 for a lamp base and a light source driver board. The direct connector 10 is mounted at the joint of a lamp base 20 and a lamp cup 30 and provided with an insulating base 11. The insulating base 11 is provided with a positive metal contact pin 12 and a negative metal contact pin 13 towards the lamp cup 30. The positive metal contact pin 12 and the negative metal contact pin 13 are electrically connected to a terminal 41 of a light source driver board 40. The insulating base 11 is provided with an insertion groove 111 towards the lamp base 20, and a rivet 21 of the lamp base 20 is inserted into the insertion groove 111. A positive conductor 14 to be electrically connected to the rivet 21 of the lamp base 20 is disposed in the insertion groove 111 and is in electrical conduction with the positive metal contact pin 12. A negative conductor 15 to tightly press against a side wall 22 of the lamp base 20 to achieve electrical connection is disposed on the side face of the insulating base 11 and is in electrical conduction with the negative metal contact pin 13.

The insulating base 11 is made from plastic materials or other insulating materials.

In the first and second embodiments of the invention, the insulating base 11 is integrally provided with an insertion pillar 16 towards the lamp cup 30. The positive metal contact pin 12 and the negative metal contact pin 13 are inserted into the insertion pillar 16 and are integrated. This structure is the simplest.

Particularly, in the first embodiment, the positive metal contact pin 12 and the positive conductor 14 are designed as an integrated structure, and the positive conductor 14 is bent to be in an n shape and erected on a side, towards the lamp base 20, of the insulating base 11 and has an end integrally connected to the positive metal contact pin 12 and an end inserted into the insertion groove 111 to be electrically connected to the rivet 21 of the lamp base 20. The negative metal contact pin 13 and the negative conductor 15 are designed as an integrated structure, and the negative conductor 15 is a linear conductor, is bent to be in an n shape and erected on the side, towards the lamp base 20, of the insulating base 11 and has an end integrally connected to the negative metal contact pin 13 and an end located on the side face of the insulating base 11 to tightly press against the side wall 22 of the lamp base 20 to achieve electrical connection.

In the second embodiment, the positive metal contact pin 12 and the positive conductor 14 are designed as an integrated structure, the positive conductor 14 is bent to be in an n shape and erected on a side, towards the lamp base 20, of the insulating base 11 and has an end integrally connected to the positive metal contact pin 12 and an end inserted into the insertion groove 111 to be electrically connected to the rivet 21 of the lamp base 20. An end, towards the lamp base 20, of the negative metal contact pin 13 is bent to be in an n shape, erected on the side, towards the lamp base 20, of the insulating base 11 and then inserted into a clamping groove 112 formed in the insulating base 11 towards the lamp base 20. The negative conductor 15 is an elastic piece-type conductor, the root portion of the negative conductor 15 is inserted into the clamping groove 112 to be electrically connected to the negative metal contact pin 13, and an elastic piece of the native conductor 15 is located on the side face of the insulating base 11 and tightly presses against and makes contact with the side wall 22 of the lamp base 20 to achieve electrical connection by means of the elasticity of the elastic piece.

In the third embodiment of the invention, the insulating base 11 is provided with a plug 17 towards the lamp cup 30 and provided with a positive socket 181 and a negative socket 182 towards the lamp base 20, and the positive socket 181 and the negative socket 182 are communicated with the plug 17. The positive metal contact pin 12 and the negative metal contact pin 13 are integrated in a PCB 19 (or circuit board) and stretch out of two ends of the PCB 19 (or circuit board). The PCB 19 (or circuit board) is inserted into the plug 17. The positive metal contact pin 12 has an end stretching into the positive socket 181 to be in electrical conduction with the positive conductor 14 and an end electrically connected to the terminal 41 of the light source driver board 40. The negative metal contact pin 13 has an end stretching into the negative socket 182 to be in electrical conduction with the negative conductor 15 and an end electrically connected to the terminal 41 of the light source driver board 40. The positive conductor 14 is bent to be in an n shape and erected on a side, towards the lamp base 20, of the insulating base 11 and has an end inserted into the positive socket 181 to be electrically connected to the positive metal contact pin 12 and an end inserted into the insertion groove 111 to be electrically connected to the rivet 21 of the lamp base 20. The negative conductor 15 is an elastic piece-type conductor, the root portion of the negative conductor 15 is inserted into the negative socket 182 to be electrically connected to the negative metal contact pin 13, and an elastic piece of the negative conductor 15 is located on the side face of the insulating base 11 and tightly presses against and makes contact with the side wall 22 of the lamp base 20 to achieve electrical connection by means of the elasticity of the elastic piece. In the third embodiment, the insulating base 11 is round and is provided with a reinforcing rib 110. In the fourth embodiment, the insulating base 11 is cuboid. As the insulating base 11 in the fourth embodiment is structurally identical with the insulating base 11 in the third embodiment in other aspects, unnecessary details will not be given anymore.

In the fifth embodiment of the invention, the insulating base 11 is provided with a plug 17 towards the lamp cup 30 and provided with a positive socket 181 and a negative socket 182 towards the lamp base 20, and the positive socket 181 and the negative socket 182 are communicated with the plug 17. The positive metal contact pin 12 and the negative metal contact pin 13 are wires (insulating sleeves 100 are disposed outside the wires) and are inserted into the plug 17. The positive metal contact pin 12 has an end stretching into the positive socket 181 to be in electrical conduction with the positive conductor 14 and an end electrically connected to the terminal 41 of the light source driver board 40. The negative metal contact pin 13 has an end stretching into the negative socket 182 to be in electrical conduction with the negative conductor 15 and an end electrically connected to the terminal 41 of the light source driver board 40. The positive conductor 14 is bent to be in an n shape and erected on a side, towards the lamp base 20, of the insulating base 11 and has an end inserted into the positive socket 181 to be electrically connected to the positive metal contact pin 12 and an end inserted into the insertion groove 111 to be electrically connected to the rivet 21 of the lamp base 20. The negative conductor 15 is an elastic piece-type conductor, the root portion of the negative conductor 15 is inserted into the negative socket 182 to be electrically connected with the negative metal contact pin 13, and an elastic piece of the negative conductor 15 is located on the side face of the insulating base 11 and tightly presses against and makes contact with the side wall 22 of the lamp base 20 to achieve electrical connection by means of the elasticity of the elastic piece. In the fifth embodiment, the insulating base 11 is also round and provided with a reinforcing rib 110.

The invention further discloses an LED bulb lamp, which comprises a lamp base 20, a lamp cup 30, a light source driver board 40 and a bulb-shaped lampshade (not shown). The lampshade and the lamp base 20 are respectively disposed at two ends of the lamp cup 30. The light source driver board 40 is disposed in the lamp cup 30 and electrically connected to the lamp base 20 through the direct connector 10. Thus, the structure is simple, the number of components is small, assembly operation is convenient, and both the production cost and the assembly cost of products are lower.

What is claimed is:

1. A direct connector for a lamp base and a light source driver board, being mounted at a joint of a lamp base and a lamp cup and being provided with an insulating base, wherein the insulating base is provided with a positive metal contact pin and a negative metal contact pin towards the lamp cup, and the positive metal contact pin and the negative metal contact pin are electrically connected to a light source driver board; the insulating base is provided with an insertion groove towards the lamp base, and a rivet of the lamp base is inserted into the insertion groove; a positive conductor to be electrically connected to the rivet of the lamp base is disposed in the insertion groove and is in electrical conduction with the positive metal contact pin; and a negative conductor to tightly press against a side wall of the lamp base to achieve electrical connection is disposed on a side face of the insulating base and is in electrical conduction with the negative metal contact pin.

2. The direct connector for the lamp base and the light source driver board according to claim 1, wherein the insulating base is made from plastic materials.

3. The direct connector for the lamp base and the light source driver board according to claim 1, wherein the insulating base is integrally provided with an insertion pillar towards the lamp cup, and the positive metal contact pin and the negative metal contact pin are inserted into the insertion pillar.

4. The direct connector for the lamp base and the light source driver board according to claim 3, wherein the positive metal contact pin and the positive conductor are integrated, the positive conductor is bent to be in an n shape and erected on a side, towards the lamp base, of the insulating base and has an end connected to the positive metal contact pin and an end inserted into the insertion groove to be electrically connected to the rivet of the lamp base.

5. The direct connector for the lamp base and the light source driver board according to claim 3, wherein the negative metal contact pin and the negative conductor are integrated, and the negative conductor is a linear conductor, is bent to be in an n shape and erected on a side, towards the lamp base, of the insulating base and has an end connected to the negative metal contact pin and an end located on a side face of the insulating base to tightly press against a side wall of the lamp base to achieve electrical connection.

6. The direct connector for the lamp base and the light source driver board according to claim 3, wherein an end, towards the lamp base, of the negative metal contact pin is bent to be in an n shape, erected on a side, towards the lamp base, of the insulating base and then inserted into a clamping groove formed in the insulating base towards the lamp base; and the negative conductor is an elastic piece-type conductor, the negative conductor is inserted into the clamping groove to be electrically connected to the negative metal contact pin, and an elastic piece of the negative conductor is located on a side face of the insulating base and tightly presses against and makes contact with a side wall of the lamp base to achieve electrical connection by means of the elasticity of the elastic piece.

7. The direct connector for the lamp base and the light source driver board according to claim 1, wherein the insulating base is provided with a plug towards the lamp cup and provided with a positive socket and a negative socket towards the lamp base, and the positive socket and the negative socket are communicated with the plug; the positive metal contact pin and the negative metal contact pin are integrated in a circuit board or a PCB and stretch out of two ends of the circuit board or the PCB, and the circuit board or the PCB is inserted into the plug; the positive metal contact pin has an end stretching into the positive socket to be in electrical conduction with the positive conductor and an end electrically connected to the light source driver board; and the negative metal contact pin has an end stretching into the negative socket to be in electrical conduction with the negative conductor and an end electrically connected to the light source driver board; the positive conductor is bent to be in an n shape and erected on a side, towards the lamp base, of the insulating base and has an end inserted into the positive socket to be electrically connected to the positive metal contact pin and an end inserted into the insertion groove to be electrically connected to the rivet of the lamp base; and the negative conductor is an elastic piece-type conductor, the negative conductor is inserted into the negative socket to be electrically connected to the negative metal contact pin, and an elastic piece of the negative conductor is located on a side face of the insulating base and tightly presses against and makes contact with a side wall of the lamp base to achieve electrical connection by means of the elasticity of the elastic piece.

8. The direct connector for the lamp base and the light source driver board according to claim 1, wherein the insulating base is provided with a plug towards the lamp cup and provided with a positive socket and a negative socket towards the lamp base, and the positive socket and the negative socket are communicated with the plug; the positive metal contact pin and the negative metal contact pin are wires and are inserted into the plug; the positive metal contact pin has an end stretching into the positive socket to be in electrical conduction with the positive conductor and an end electrically connected to the light source driver board; and the negative metal contact pin has an end stretching into the negative socket to be in electrical conduction with the negative conductor and an end electrically connected to the light source driver board; the positive conductor is bent to be in an n shape and erected on a side, towards the lamp base, of the insulating base and has an end inserted into the positive socket to be electrically connected to the positive metal contact pin and an end inserted into the insertion groove to be electrically connected to the rivet of the lamp base; and the negative conductor is an elastic piece-type conductor, the negative conductor is inserted into the negative socket to be electrically connected to the negative metal contact pin, and an elastic piece of the negative conductor is located on a side face of the insulating base and tightly presses against and makes contact with a side wall of the lamp base to achieve electrical connection by means of the elasticity of the elastic piece.

9. The direct connector for the lamp base and the light source driver board according to claim 1, wherein the insulating base is round and is provided with a reinforcing rib, or is cuboid.

10. An LED bulb lamp, comprising a lamp base, a lamp cup, a light source driver board and a bulb-shaped lampshade, wherein the lampshade and the lamp base are respectively disposed at two ends of the lamp cup, the light source driver board is disposed in the lamp cup and electrically connected to the lamp base through the direct connector for the lamp base and the light source driver board according to claim 1.

* * * * *